US005927268A

United States Patent [19]

Chiang et al.

[11] Patent Number: 5,927,268

[45] Date of Patent: Jul. 27, 1999

[54] SMOKE EXHAUSTER

[76] Inventors: Chao Cheng Chiang; Chi Shyong Chiang, both of P.O. Box 63-151, Taichung, Taiwan

[21] Appl. No.: 08/992,021

[22] Filed: Dec. 17, 1997

[51] Int. Cl.[6] ..... F24C 15/20

[52] U.S. Cl. ..... 126/299 D; 126/299 R

[58] Field of Search ..... 126/299 R, 299 D

[56] References Cited

U.S. PATENT DOCUMENTS 2,596,874 5/1952 Sonntag ..... 126/299 D 3,719,137 3/1973 Gould ..... 126/299 D 5,027,790 7/1991 Sheng ..... 126/299 D

*Primary Examiner*—Carroll B. Dority

[57] ABSTRACT

A smoke exhauster includes a housing having a top flue. A casing is secured to the housing and has an outlet communicating with the flue and has one or more front openings for engaging with one or more fan devices. A smoke guide is secured to the front portion of the housing and has a chamber for receiving and collecting smoke. The fan devices may draw the smoke in the smoke guide into the casing and outward through the outlet. The smoke guide 20 may receive and collect and guide the smoke for allowing the smoke to be effectively drawn by the fan devices.

8 Claims, 3 Drawing Sheets

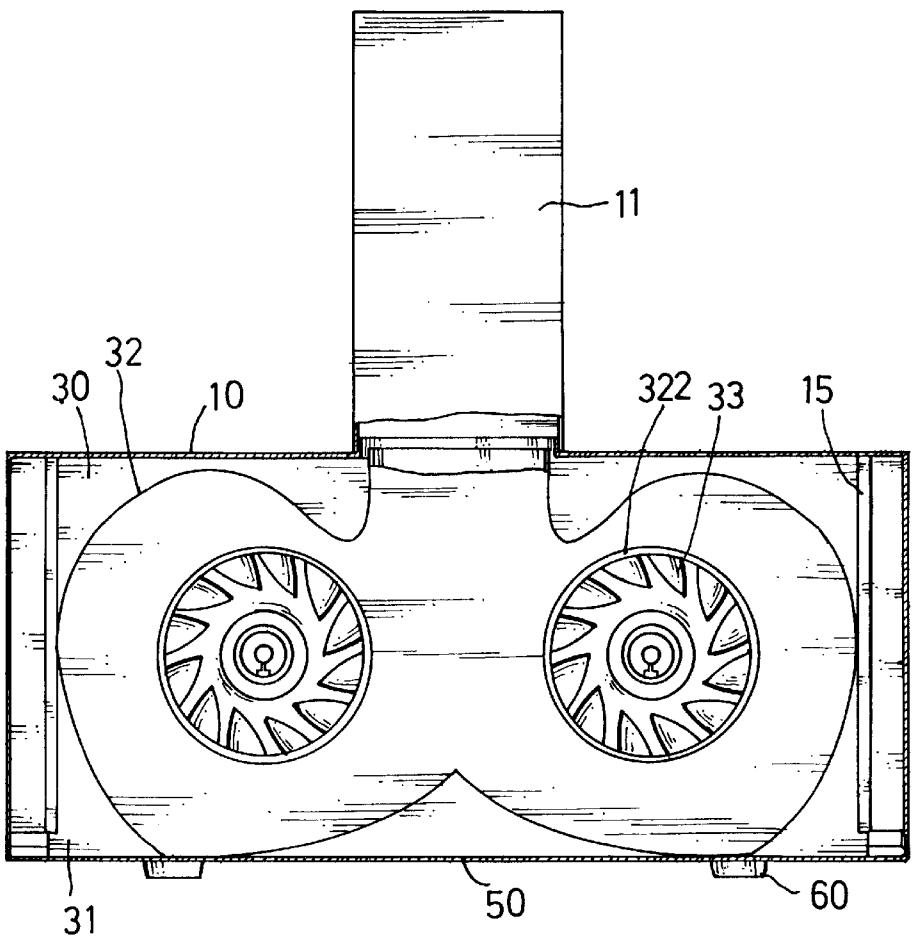
FIG. 5
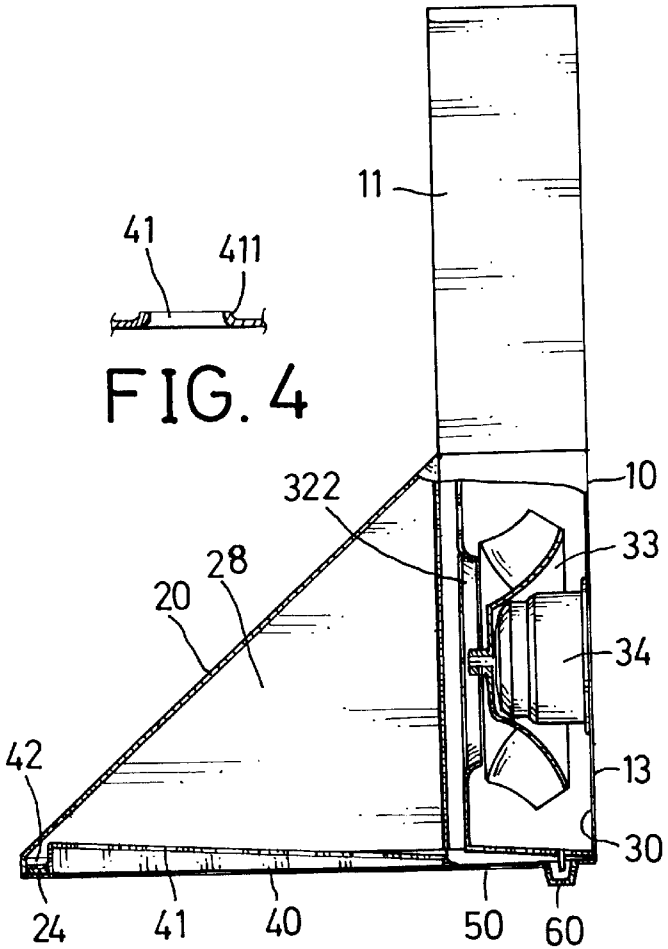
FIG. 3
FIG. 4

SMOKE EXHAUSTER

BACKGROUND OF THE INVENTION

1. Field of the Invention

The present invention relates to a smoke exhauster, and more particularly to a smoke exhauster having a smoke guide for guiding and for collecting the smoke.

2. Description of the Prior Art

U.S. Pat. No. 5,230,327 to Jang et al. discloses a typical smoke exhauster including a bottom plate having two openings for engaging with two fan devices. However, only the two openings of the bottom portion of the smoke exhauster are opened for receiving the smoke. The smoke may not flow through the other solid portion of the bottom portion of the smoke exhauster such that the smoke drawing effect is limited. In addition, the motors are normally disposed above the fan device.

The present invention has arisen to mitigate and/or obviate the afore-described disadvantages of the conventional smoke exhausters.

SUMMARY OF THE INVENTION

The primary objective of the present invention is to provide a smoke exhauster including a smoke guide for guiding and for facilitating the collection of the smoke.

In accordance with one aspect of the invention, there is provided a smoke exhauster comprising a housing including an upper portion having a flue and including a front portion and a rear portion, a casing disposed in the housing and secured to the rear portion of the housing, the casing including an upper portion having an outlet communicating with the flue, the casing including a front portion having at least one opening, a smoke guide secured to the front portion of the housing and including a chamber for receiving and for collecting smoke, at least one fan device disposed in the casing and disposed behind the opening of the casing for drawing the smoke in the smoke guide into the casing and outward through the outlet, and means for driving the fan device.

The rear portion of the housing includes a pair of channels, the casing includes a plate having two sides engaged in the channels for securing the casing to the rear portion of the housing.

The front portion of the housing includes a notch, the smoke guide includes two side panels secured to the front portion of the housing for enclosing the notch. The notch is inverted V-shaped, the front portion of the housing includes a pair of slits, the side panels of the smoke guide each includes a flange engaged with the slits for securing the smoke guide to the housing. The smoke guide includes a front panel, the front panel and the side panels are inclined for forming a triangular pyramid structure.

The housing includes a bottom portion and includes a cap secured to the bottom portion of the housing, the cap includes a rear portion having at least one aperture, and at least one cup secured to the cap and disposed below the aperture for collecting oil.

The smoke guide includes a bottom portion and includes a board secured to the bottom portion of the smoke guide, the board includes a plurality of holes for allowing the smoke to flow into the chamber of the smoke guide via the holes. The board includes a plurality of upward extending peripheral walls for defining the holes.

Further objectives and advantages of the present invention will become apparent from a careful reading of a detailed description provided hereinbelow, with appropriate reference to accompanying drawings.

BRIEF DESCRIPTION OF THE DRAWINGS

FIG. 3 is a partial cross sectional view taken along lines 3—3 of FIG. 1;

FIG. 4 is an enlarged partial cross sectional view of the bottom board of the smoke exhauster; and FIG. 5 is a front view of the smoke exhauster, in which the smoke guide is removed for showing the interior of the smoke exhauster.

DETAILED DESCRIPTION OF THE PREFERRED EMBODIMENT

Figure 1:
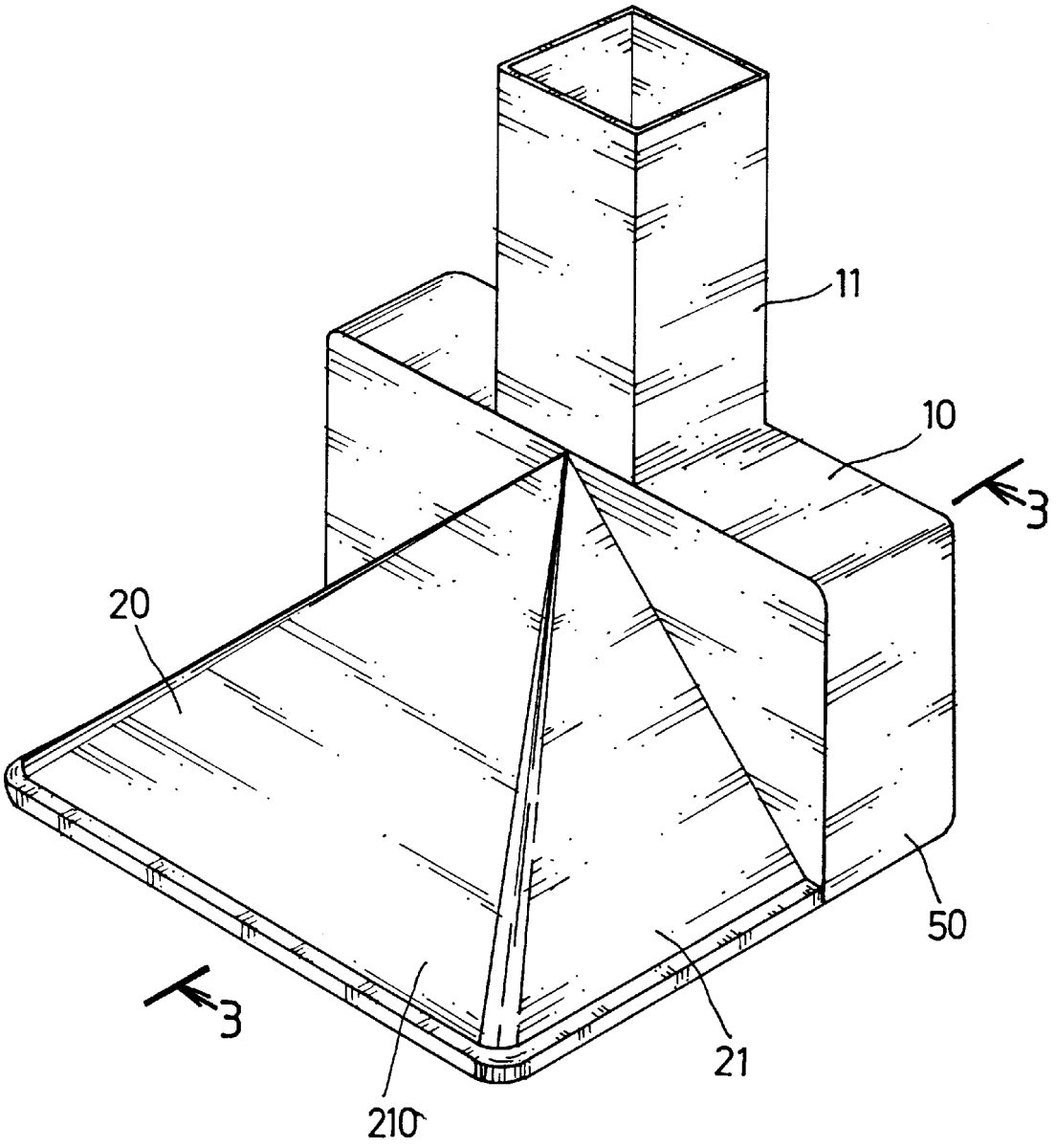
FIG. 1 is a perspective view of a smoke exhauster in accordance with the present invention.
Figure 2:
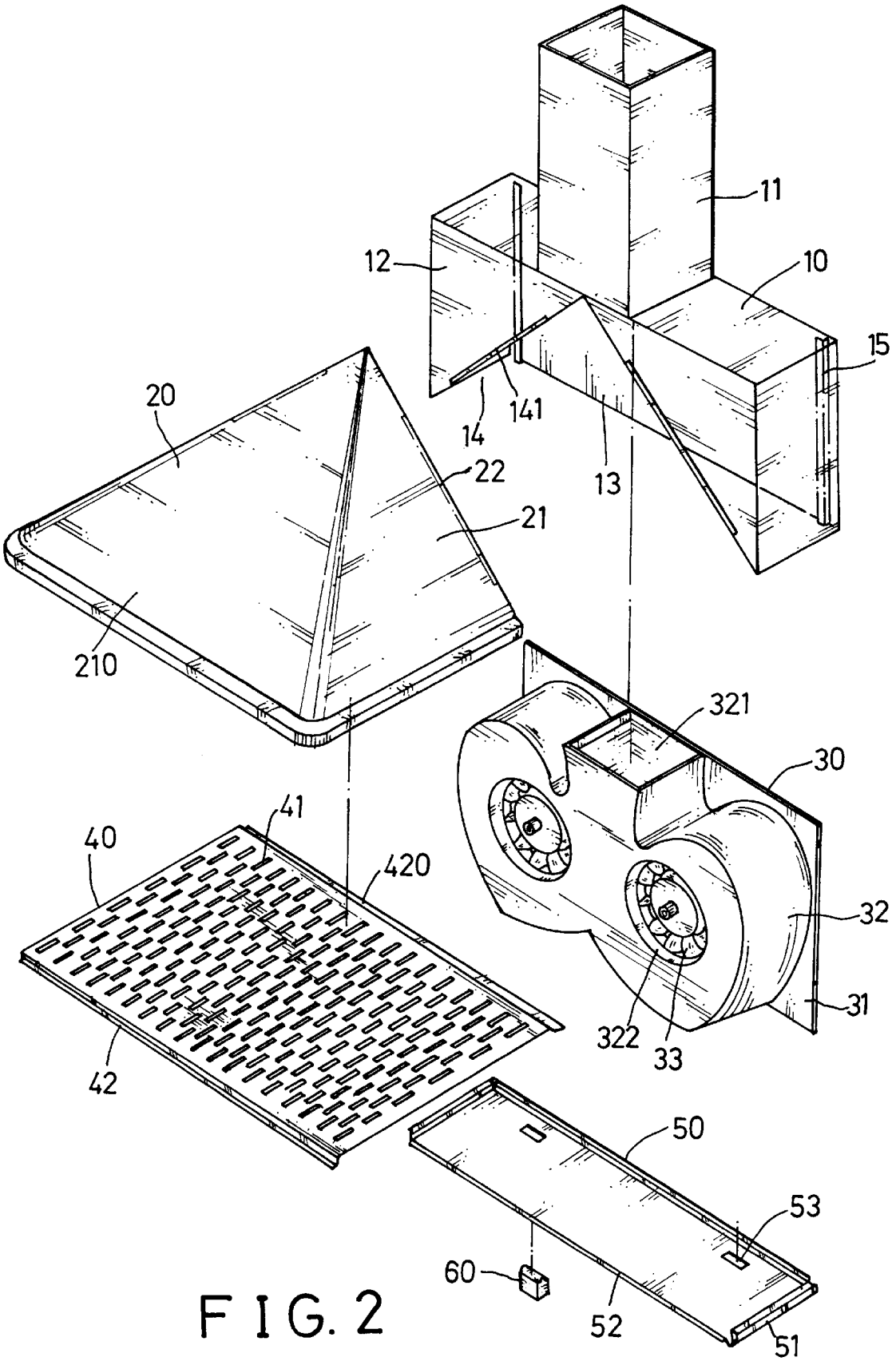
FIG. 2 is an exploded view of the smoke exhauster.

Referring to the drawings, and initially to FIGS. 1–3 and 5, a smoke exhauster in accordance with the present invention comprises a housing 10 including a flue 11 provided on top and including a front portion having an inverted V-shaped notch 14 and having a pair of inclined slits 141 formed above the notch 14. The housing 10 includes a rear portion 13 having a pair of vertical channels 15.

A plate 30 includes two sides 31 engaged in the channels 15. A casing 32 is secured to the plate 30 and includes an outlet 321 provided on top for communicating with the flue 11 of the housing 10 and includes one or more openings 322 provided in the front portion. One or more centrifugal fan devices 33 are disposed in the casing 32 and disposed behind the openings 322 for drawing the smoke inward of the casing 32 and outward through the outlet 321 and the flue 11. One or more motors 34 are secured to the respective centrifugal fan devices 33 for driving the fan devices 33. It is preferable that a pair of fan devices 33 are used and the outlet 321 is disposed in the middle portion for receiving the smoke drawn from the fan devices 33.

A smoke guide 20 is secured to the front portion 12 of the housing 10 for enclosing the notch 14 and includes two side panels 21 each having a flange 22 engaged through the slits 141 of the housing 10 and folded for securing the smoke guide 20 to the housing 10. The front panel 210 and the side panels 21 are inclined for forming a triangular pyramid structure and for forming a chamber 28 for receiving and guiding the smoke and for allowing the smoke to be collectively and effectively drawn by the fan device. The front panel 210 includes an ear 24 provided in the bottom and extended inward of the smoke guide 20 (FIG. 3).

A board 40 is disposed in the bottom of the smoke guide 20 and includes a front portion 42 engaged on the ear 24 of the smoke guide 20 and includes a rear portion 420. The board 40 includes a number of holes 41 each defined by an upward extending peripheral wall 411 (FIG. 4) which may prevent the collected oil from flowing downward through the holes 41.

A cap 50 is secured to the bottom of the housing 10 and includes a front portion 52 engaged below the rear portion 420 of the board 40 and includes a peripheral rib 51 for securing to the bottom peripheral portion of the housing 10 by such as welding processes, or by fasteners. As shown in FIG. 3, the board 40 and the cap 50 are inclined and arranged for allowing the oil collected on top of the board 40 and the cap 50 to flow toward the rear portion of the cap 50. The cap 50 includes one or more apertures 53 formed in the rear portion. One or more cups 60 are secured to the cap 50 and disposed below the apertures 53 for collecting the collected oil.

In operation, as shown in FIG. 3, the smoke may first flow into the chamber 28 of the smoke guide 20 before being drawn out through the outlet 321 and the flue 11. The smoke guide 20 may receive and collect and guide the smoke for allowing the smoke to be effectively drawn by the fan devices.

Accordingly, the smoke exhauster in accordance with the present invention includes a smoke guide for guiding and for facilitating the collection of the smoke.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A smoke exhauster comprising:

a housing including an upper portion having a flue and including a front portion and a rear portion, a casing disposed in said housing and secured to said rear portion of said housing, said casing including an upper portion having an outlet communicating with said flue, said casing including a front portion having at least one opening, a smoke guide secured to said front portion of said housing and including a chamber for receiving and for collecting smoke, at least one fan device disposed in said casing and disposed behind said at least one opening of said casing for drawing the smoke in said smoke guide into said casing and outward through said outlet, and means for driving said at least one fan device.

2. The smoke exhauster according to claim 1, wherein said rear portion of said housing includes a pair of channels, said casing includes a plate having two sides engaged in said channels for securing said casing to said rear portion of said housing.

3. The smoke exhauster according to claim 1, wherein said front portion of said housing includes a notch, said smoke guide includes two side panels secured to said front portion of said housing for enclosing said notch.

4. The smoke exhauster according to claim 3, wherein said notch is inverted V-shaped, said front portion of said housing includes a pair of slits, said side panels of said smoke guide each includes a flange engaged with said slits for securing said smoke guide to said housing.

5. The smoke exhauster according to claim 4, wherein said smoke guide includes a front panel, said front panel and said side panels are inclined for forming a triangular pyramid structure.

6. The smoke exhauster according to claim 1, wherein said housing includes a bottom portion and includes a cap secured to said bottom portion of said housing, said cap includes a rear portion having at least one aperture, and at least one cup secured to said cap and disposed below said at least one aperture for collecting oil.

7. The smoke exhauster according to claim 1, wherein said smoke guide includes a bottom portion and includes a board secured to said bottom portion of said smoke guide, said board includes a plurality of holes for allowing the smoke to flow into said chamber of said smoke guide via said holes.

8. The smoke exhauster according to claim 7, wherein said board includes a plurality of upward extending peripheral walls for defining said holes.

* * * * *